US009409217B2

(12) United States Patent
Fiorucci

(10) Patent No.: US 9,409,217 B2
(45) Date of Patent: Aug. 9, 2016

(54) MODULAR FINISHING MILL

(71) Applicant: Siemens Industry, Inc., Alpharetta, GA (US)

(72) Inventor: Keith Fiorucci, Sturbridge, MA (US)

(73) Assignee: PRIMETALS TECHNOLOGIES USA LLC, Alpharetta, GA (US)

( * ) Notice: Subject to any disclaimer, the term of this patent is extended or adjusted under 35 U.S.C. 154(b) by 0 days.

(21) Appl. No.: 14/428,725

(22) PCT Filed: Sep. 23, 2013

(86) PCT No.: PCT/US2013/061129

§ 371 (c)(1),
(2) Date: Mar. 17, 2015

(87) PCT Pub. No.: WO2014/052222

PCT Pub. Date: Apr. 3, 2014

(65) Prior Publication Data

US 2015/0217350 A1 Aug. 6, 2015

Related U.S. Application Data

(60) Provisional application No. 61/705,233, filed on Sep. 25, 2012.

(51) Int. Cl.

| | |
|---|---|
| ***B21B 35/14*** | (2006.01) |
| ***B21B 1/18*** | (2006.01) |
| ***B21B 35/04*** | (2006.01) |
| ***B21B 31/02*** | (2006.01) |
| ***B21B 35/02*** | (2006.01) |
| ***B21B 35/12*** | (2006.01) |

(52) U.S. Cl.
CPC . *B21B 35/14* (2013.01); *B21B 1/18* (2013.01); *B21B 31/02* (2013.01); *B21B 35/02* (2013.01); *B21B 35/04* (2013.01); *B21B 35/12* (2013.01); *B21B 35/143* (2013.01)

(58) Field of Classification Search
CPC ..... B21B 35/02; B21B 35/04; B21B 35/12; B21B 35/14; B21B 35/143; B21B 1/18
See application file for complete search history.

(56) References Cited

U.S. PATENT DOCUMENTS

| | | | | |
|---|---|---|---|---|
| 4,019,360 | A * | 4/1977 | Biernot et al. | 72/249 |
| 5,595,083 | A * | 1/1997 | Shore | 72/249 |
| 2008/0196469 | A1 * | 8/2008 | Shore | 72/234 |
| 2012/0216588 | A1 * | 8/2012 | Klingen et al. | 72/234 |

FOREIGN PATENT DOCUMENTS

| | | | |
|---|---|---|---|
| DE | 19619134 | A1 | 11/1997 |
| DE | 102009050710 | A1 | 4/2011 |
| FR | 1314917 | A | 1/1963 |

OTHER PUBLICATIONS

PCT International Search Report mailed Mar. 7, 2014 corresponding to PCT International Application No. PCT/US2013/061129 filed Sep. 23, 2013.

* cited by examiner

*Primary Examiner* — Debra Sullivan
(74) *Attorney, Agent, or Firm* — Gesmer Updegrove LLP

(57) ABSTRACT

A modular rolling mill includes a plurality of rolling units arranged along a mill pass line, each rolling unit being independently driven by a dedicated motor and drive train; and clutches for selectively coupling and de-coupling the drive trains of successive pairs of rolling units.

10 Claims, 2 Drawing Sheets

MODULAR FINISHING MILL

CROSS REFERENCE TO RELATED APPLICATIONS

This application claims benefit, under 35 U.S.C. §119(e), of U.S. Provisional Application Ser. No. 61/705,233 filed on 25 Sep. 2012, the contents and substance of which are herein incorporated by reference.

BACKGROUND

1. Field

Embodiments of the present invention relate generally to rolling mills, and are concerned in particular with the provision of an improved modular rolling mill for finish rolling long products such as round rods and bars as well as shaped products.

2. Description of Related Art

As disclosed, for example, in U.S. Pat. No. 4,537,055 (Woodrow et al.) and U.S. Pat. No. 5,152,165 (Shore et al.), known block type finishing mills typically comprise multiple mechanically coupled roll stands driven by a common motor.

It is also known, as disclosed for example in U.S. Pat. No. 5,595,083 (Shore) and U.S. Pat. No. 7,191,629 (Shore et al.), to subdivide the finishing mill into multiple mechanically coupled rolling units, each of which includes two pairs of work rolls.

In these finishing mills, because the roll stands or rolling units are permanently coupled mechanically, the inertia of the entire mill serves to dampen impact speed drops caused by the entry of a product front end into the successive roll passes. On the negative side, however, is the relatively high cost of such finishing mills, due in large part to the complex and costly gear trains required to achieve mechanical coupling of the roll stands or rolling units, and the large and costly motors employed to drive the mills

SUMMARY

Broadly stated, embodiments of the present invention are directed to the provision of a modular finishing mill comprising a plurality of rolling units arranged along a mill pass line, with each rolling unit being independently driven by a dedicated motor and drive train, and with clutches for selectively and temporarily coupling and de-coupling the drive trains of successive pairs of the rolling units.

In exemplary embodiments, the rolling units include pairs of work rolls carried on roll shafts, with the drive trains comprising gear sets mechanically coupling the roll shafts to drive shafts powered by the motors.

The drive shafts may all be driven at substantially the same speed, with the gear sets being configured and arranged to effect stepped increases in the speed of the roll shafts of successive roll pairs.

The clutches may be interposed between the drive shafts of successive rolling units, and may comprise electro magnetic or ferro fluid clutches.

In an exemplary method of rolling a product of finite length with a modular finishing mill in accordance with the present invention, successive pairs of the rolling units are coupled together prior to the arrival of a product front end at the first rolling unit. The coupling of the rolling units is maintained until the product front end has cleared the last rolling unit, at which time the rolling units are de-coupled and maintained in a de-coupled state while rolling the remaining product length.

These and other features and advantages of the present invention will become more apparent upon reading the following detailed description in conjunction with the accompanying drawings.

DETAILED DESCRIPTION

The components described herein as making up the various embodiments are intended to be illustrative and not restrictive. Many suitable components that would perform the same or a similar function as well as the materials described herein are intended to be embraced within the scope of embodiments of the present invention.

Figure 1:
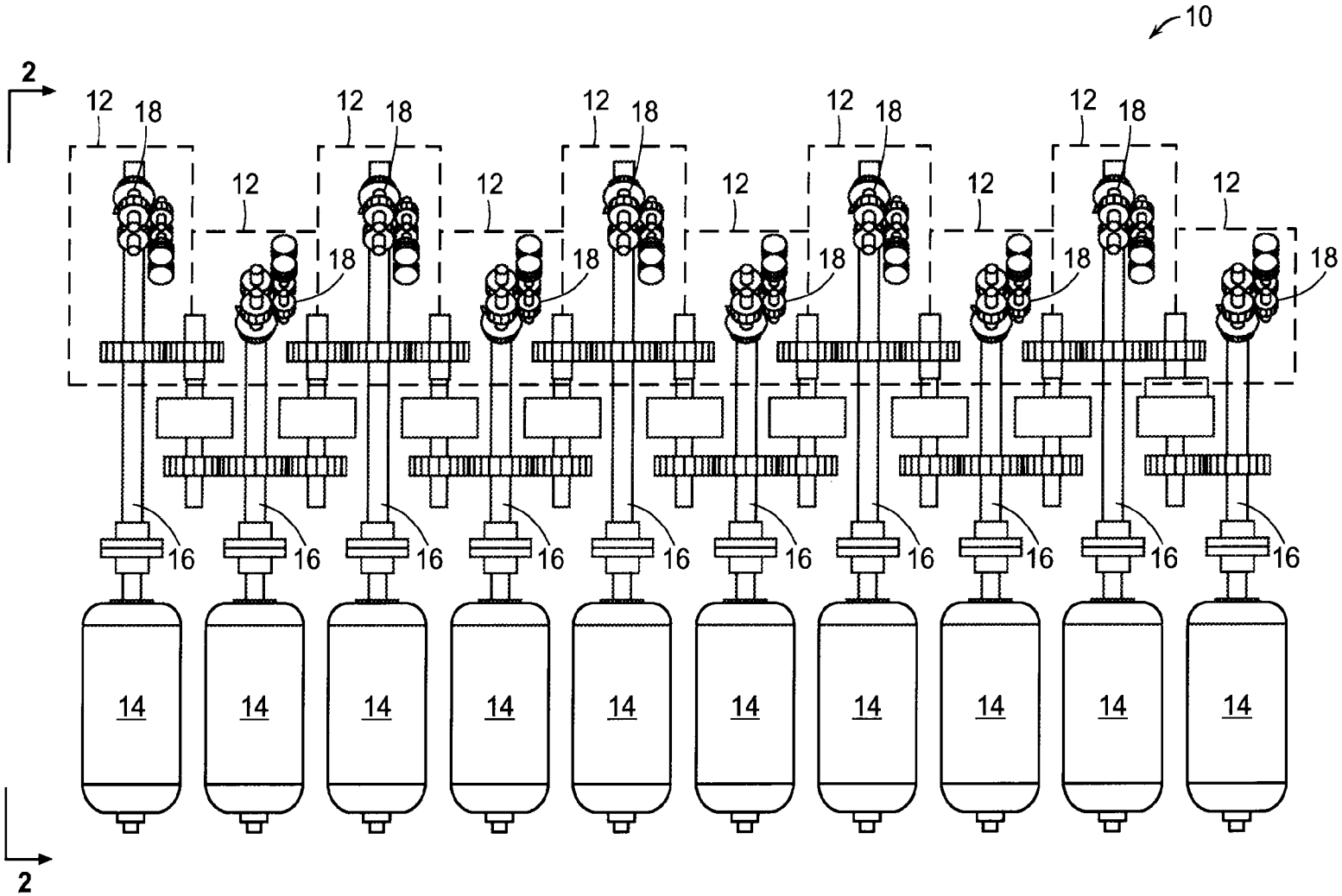
FIG. 1 is a plan view of a modular finishing mill in accordance with an exemplary embodiment of the present invention.
Figure 2:
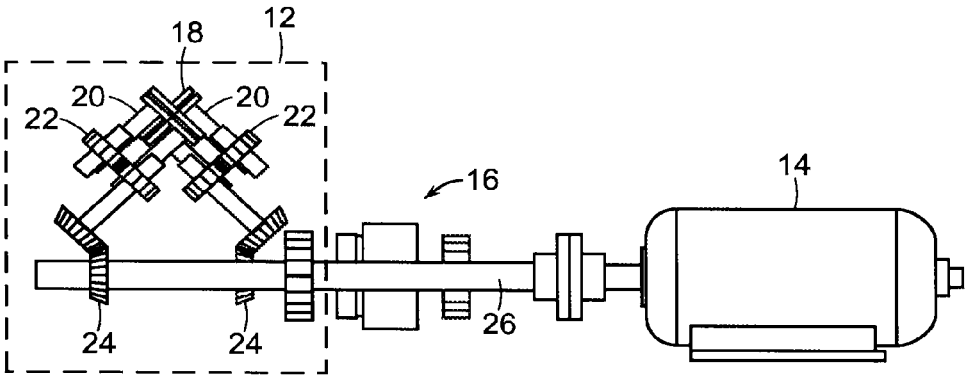
FIG. 2 is a sectional view taken along line 2-2 of FIG. 1.

Referring now to the figures, wherein like reference numerals represent like parts throughout the views, an illustrative embodiment of a modular finishing mill in accordance with the present invention is generally depicted at 10. The mill comprises a plurality of rolling units 12 arranged in succession along a mill pass line. Each rolling unit 12 is independently driven by a dedicated motor 14 and drive train 16. Each rolling unit 12 may employ two pairs of work rolls indicated typically at 18. As can be best seen in FIG. 2, the work rolls are carried on roll shafts 20 mechanically coupled by gear sets 22, 24 to a drive shaft 26 comprising part of the drive train 16. The drive shafts of adjacent rolling units are parallel.

Figure 3:
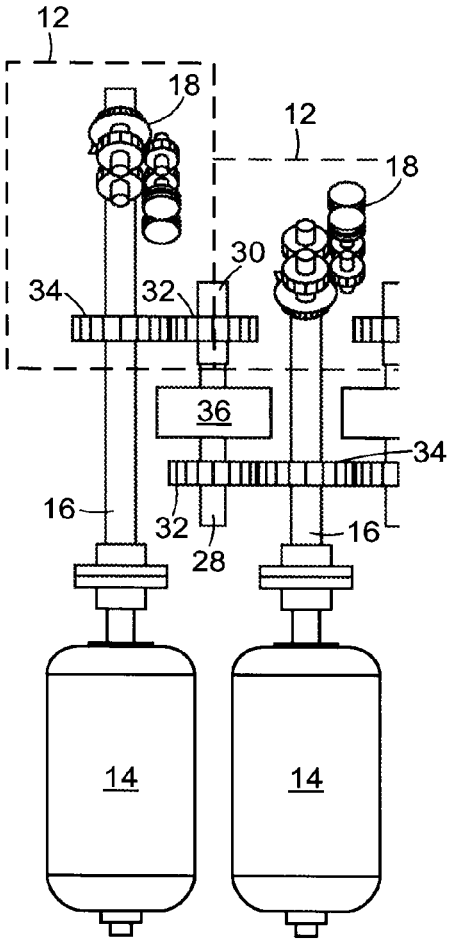
FIG. 3 is an enlarged plan view of a portion of the modular finishing mill shown in FIG. 1.

As depicted in FIG. 3, axially aligned first and second stub shafts 28, 30 are provided between adjacent drive shafts 16. Each of the stub shafts 28, 30 carries a gear 32 in meshed relationship with a gear 34 on a respective one of the adjacent drive shafts 16. The stub shafts 28, 30 are interconnected by clutches 36, which may comprise electro magnetic or ferro fluid clutches.

When the clutches 36 are disengaged, the stub shafts 28, 30 are disconnected and free to rotate independently of each other, resulting in a de-coupling of the adjacent rolling units 12. Engagement of the clutches 36 may provide up to 100% lock up of the stub shafts 28, 30, with the engaged gear sets 32, 34 serving to mechanically couple the adjacent rolling units 12.

When rolling a product of finite length with the above described illustrative embodiment of a finishing mill in accordance with the present invention, prior to the arrival of a product front end at the first rolling unit 12, the clutches 36 may be engaged to achieve a coupling of successive rolling units. Coupling may be maintained while the product front end negotiates each of the roll passes defined by the successive pairs of work rolls 18. After the product front end has cleared the roll pass of the last rolling unit, the clutches 36 may be disengaged, allowing the rolling units 12 to operate independently while rolling the remaining length of the product.

When the successive rolling units 12 are coupled together, the inertia of the entire mill is available to dampen any impact speed drop caused by the entry of a product front end into the roll passes of a successive roll pairs.

While exemplary embodiments of the present invention have been disclosed, modifications, additions and deletions can be made without departing from the spirit and scope of the invention and its equivalents, as set forth in the following claims.

What is claimed is:

1. A modular rolling mill, comprising:

a plurality of rolling units arranged along a mill pass line, each rolling unit being independently driven by a dedicated motor and drive train; and clutches for selectively coupling and de-coupling the drive trains of successive pairs of rolling units, wherein when the clutches disengage, the rolling units are allowed to operate independently while rolling a remaining length of a product through the mill pass line.

2. The modular rolling mill of claim 1 wherein said rolling units employ pairs of work rolls carried on roll shafts, and wherein said drive trains comprise gear sets mechanically coupling said rolls shafts to drive shafts powered by said motors.

3. The modular rolling mill of claim 2 wherein said drive shafts are driven at substantially the same speed, and wherein said gear sets are configured and arranged to effect stepped increases in the speed of the roll shafts of successive rolling units.

4. The modular rolling mill of claim 3 wherein said clutches are interposed between the drive shafts of successive rolling units.

5. The modular rolling mill of claim 4 wherein said clutches comprise either electromagnetic clutches or ferro fluid clutches.

6. The modular rolling mill of claim 1 wherein said drive trains include drive shafts, with the drive shafts of adjacent rolling units being parallel.

7. The modular rolling mill of claim 6 further comprising axially aligned and independently rotatable first and second stub shafts arranged between and parallel to the drive shafts of adjacent rolling units, said first stub shaft being mechanically coupled to the drive shaft of one of said adjacent rolling units, and said second drive shaft being mechanically coupled to the drive shaft of the other of said adjacent rolling units, with said clutches being arranged to couple and de-couple said stub shafts.

8. A method of rolling a product of finite length through a modular rolling mill comprising a plurality of separately driven rolling units arranged in succession along a mill pass line, said method comprising:

temporarily coupling successive pairs of said rolling units prior to the arrival of a front end of said product at the first of said rolling units;

maintaining the coupling of said rolling units until the product front end has cleared the last of said rolling units; and then de-coupling said rolling units for continued operation in a de-coupled state while rolling a remaining length of said product.

9. The method of claim 8 wherein said rolling units employ pairs of work rolls carried on roll shafts, wherein gear sets mechanically couple the roll shafts to drive shafts powered by motors, and wherein the successive pairs of rolling units are coupled and de-coupled by clutches interposed between said drive shafts.

10. A method of rolling a product of finite length through a modular rolling mill comprising a succession of separately driven rolling units, wherein a speed drop is occasioned by the arrival of a front end of the product at each rolling unit, said method comprising:

temporarily maintaining successive pairs of said rolling units in a coupled state while front end of said product passes through said rolling mill; and after the front end of said product has cleared the last rolling unit, de-coupling and maintaining said rolling units in a de-coupled state during the rolling of remainder of said product length through said rolling mill.

* * * * *